US006112359A

United States Patent [19]

Kaleta

[11] Patent Number: 6,112,359

[45] Date of Patent: Sep. 5, 2000

[54] BROOM WITH BRISTLE CLEANING MECHANISM

[76] Inventor: Bryan Kaleta, 312 Arboresum Dr., Lombard, Ill. 60148

[21] Appl. No.: 09/327,274

[22] Filed: Jun. 7, 1999

[51] Int. Cl.[7] ..... A46B 17/06

[52] U.S. Cl. ..... 15/142; 15/169

[58] Field of Search ..... 15/142, 169, 246

[56] References Cited

U.S. PATENT DOCUMENTS

| | | | |
|---|---|---|---|
| 1,325,200 | 12/1919 | Kirsch | 15/246 |
| 2,197,695 | 4/1940 | Hendricks | 15/246 |
| 3,170,182 | 2/1965 | Burian | 15/142 |
| 5,802,657 | 9/1998 | Nogues et al. | 15/142 |
| 6,032,447 | 3/2000 | Shelton | 15/246 |

*Primary Examiner*—Terrence R. Till
*Attorney, Agent, or Firm*—Knechtel, Demeur & Samlan

[57] ABSTRACT

A broom for cleaning a surface having a bristle cleaning mechanism. The broom has a handle with a grasping end and a cleaning end. At the cleaning end is a comb member having a plurality of tines. The comb member pivots into and out of engagement with the bristles as a sleeve or handle is moved along the broom handle. The tines engage the bristles as the grasping portion is pushed downward such that the tines push trapped dirt and dust out from the bristle ends. As the slidable sleeve is pulled back into its original position, the tines disengage from the bristles and return to their original position.

20 Claims, 3 Drawing Sheets

BROOM WITH BRISTLE CLEANING MECHANISM

I. BACKGROUND OF THE INVENTION

This invention relates generally to floor cleaning devices, and more particularly, to a hand held broom having a mechanism to clean the broom's bristles.

II. BRIEF DESCRIPTION OF THE PRIOR ART

Numerous brooms have been invented and used over the years. Generally, they all allow the use to stand upright while sweeping the floor surface. At the bottom of a long handle is generally found a plurality of cleaning bristles with one end of the bristles attached to the end of the handle and the other end of the bristles contacting the floor. The broom is moved in an arc in a sweeping motion with the loose end of the bristles contacting the floor in order to sweep dust and dirt from the floor surface. Different types of handles and bristles have been used in the past but none of the devices employ a mechanism to clean the dust and dirt entrapped between the bristles. This results in a build-up of dust and dirt between the broom's bristles. This effects the efficiency of the broom. In the past, in order to clean the bristles, the broom was shaken or the user would place his or her hand between the bristles in order to pull out the dust and entrapped dirt.

It is obvious that the user would prefer not to place his or her hand into the dirty bristles in order to remove the entrapped dust and dirt. Not only is this unsanitary but it can result in the spread of germs from the area cleaned on to the user's hand. Furthermore, it is not safe for the user to place his or her hand into the bristles as the bristles may have picked up sharp objects such as tacks, nails, or broken glass. If these are entrapped between bristles in the center part of the broom, the user cannot see them which could result in an injury when trying to clean the area between the bristles.

In the past there has never been a broom that provided for a bristle cleaning mechanism that is easy to use and is a part of the broom.

III. OBJECTS AND ADVANTAGES OF THE INVENTION

It is an object of the present invention to provide an improved broom having a mechanism mounted on the broom that cleans the bristles.

Another related object is to provide a broom having a cleaning mechanism that is actuated by the user and does not require the user to place his or her hands inside the bristles in order to clean the bristles.

It is another object to provide a broom having a bristle cleaning mechanism in which the bristle cleaning mechanism is a comb assembly in which the tines of the comb pass through the bristles in order to remove entrapped dirt and dust.

It is yet another object to provide a broom with a bristle cleaning assembly wherein the bristle cleaning assembly does not interfere with the normal cleaning operation of the broom as it is being used.

These and other objects and advantages will be apparent upon reading the description of the drawings and description of the preferred embodiment.

IV. SUMMARY OF THE INVENTION

The present invention is a hand held broom for cleaning floors and other flat surfaces. There is an elongated handle having a longitudinal axis with a cleaning head at the bottom end of the handle. The cleaning head has a clustering of bristles with an end affixed to the cleaning head. The opposite end of the bristles is loose and free to contact the surface to be cleaned in the normal manner in which brooms are used. A collar surrounds the end of the bristles affixed to the bottom end of the broom handle. A comb member with a plurality of tines is pivotally connected to the collar. The comb member is pivoted from a first position with the tines not in engagement with the bristles to a second position with the tines in contact with the bristles. A hand held actuating mechanism is connected to the comb member causing it to pivot between the first and second positions. The comb, once pivoted to a position in which the tines are engaging the bristles, can be pushed through the tines from the top of the bristles down through the end of the bristles. This causes any dirt and dust entrapped between the bristles to be pushed out and away from the loose ends of the bristles.

V. BRIEF DESCRIPTION OF THE DRAWINGS

VI. DESCRIPTION OF THE PREFERRED EMBODIMENT

Figure 1:
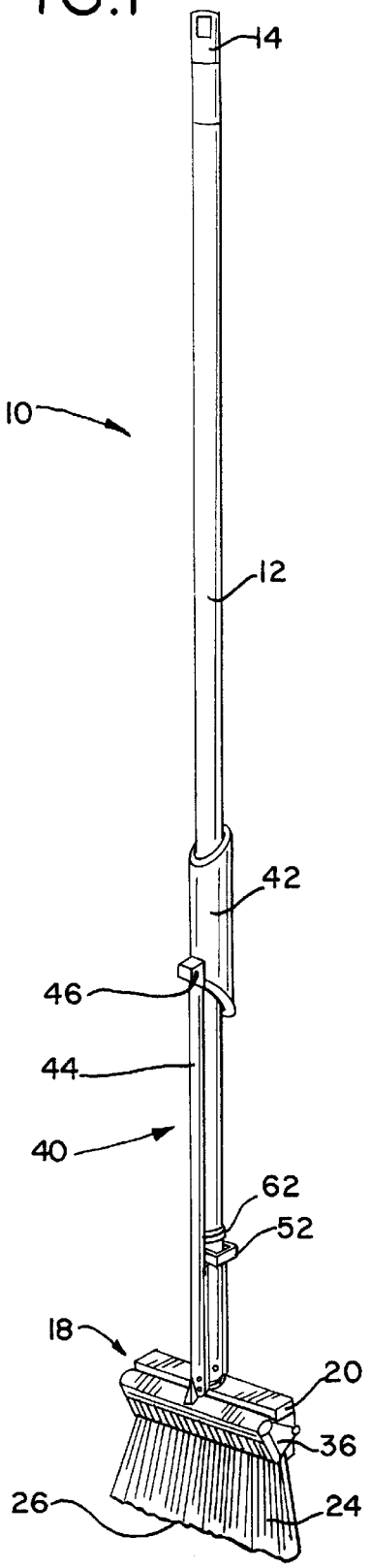
FIG. 1 is a perspective view of the inventive broom assembly.
Figure 2:
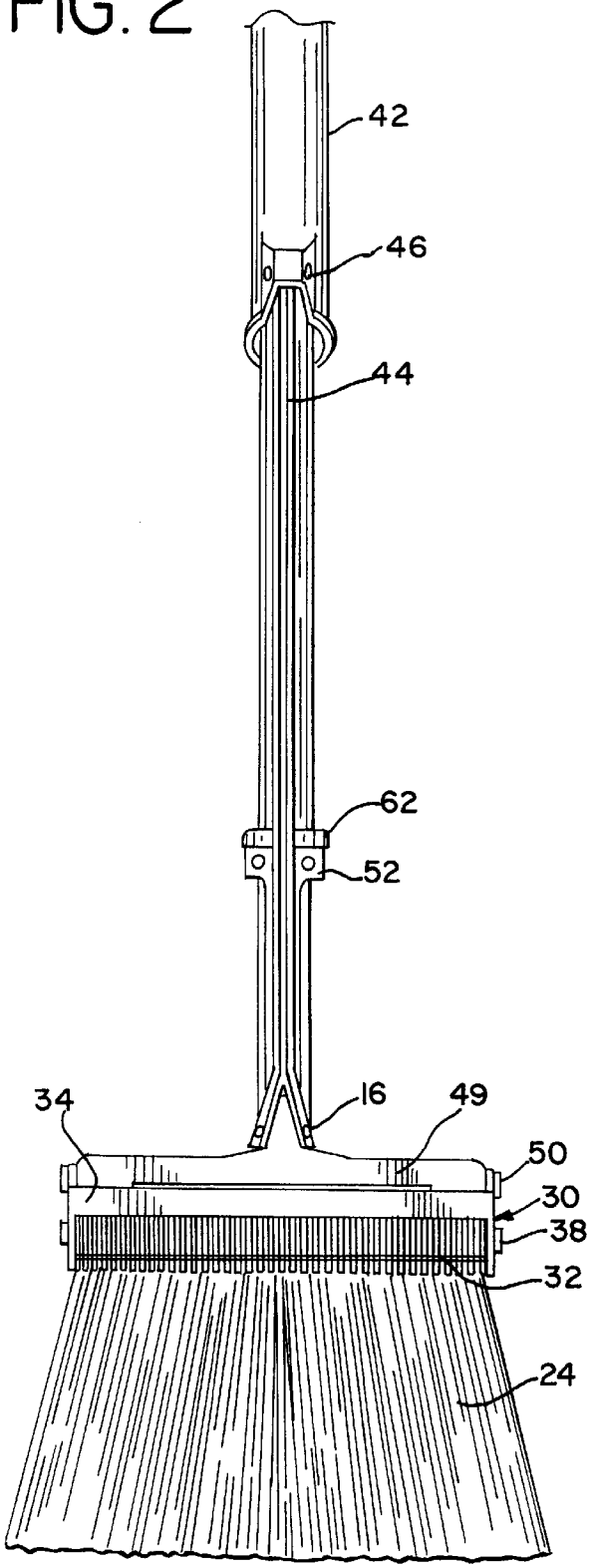
FIG. 2 is a front elevation view with portions removed of broom with the comb assembly in its first position not engaging the bristles.

Turning to FIG. 1, a broom 10 of the present invention is illustrated. There is an elongated handle 12 having a top end 14 and a bottom end 16. The elongated handle 12 has a longitudinal axis extending along the entire length of the handle 12. The overall length of the handle 12 is approximately 4 to 5 feet in length. Attached to the bottom end 16 is a cleaning head 18. The cleaning head 18 is comprised of a bristle holder 20 which securely holds one end 22 of a plurality of bristles 24. The opposite end of the bristles 26 are adapted to contact and clean the surface or floor which is to be swept. The configuration of the bristles in the cleaning head 18 and the manner in which they fan out from the cleaning head as seen in FIG. 2 is characteristic of numerous brooms of the prior art.

A bottom collar 28 (most clearly illustrated in FIGS. 3 and 4) completely surrounds or encompasses the one end 22 of the bristles. Attached to the bottom collar 28 is a comb assembly 30. The comb assembly 30 is comprised of a plurality of tines 32 extending from and attached to a comb head 34. The comb head 34 extends across the entire width of the bottom collar 28. The comb assembly 30 is attached to the bottom collar 28 by means of a collar pivot pin 38 that passes through a link 36 to pivotally connect the link 36 to the bottom collar 28.

Figure 6:
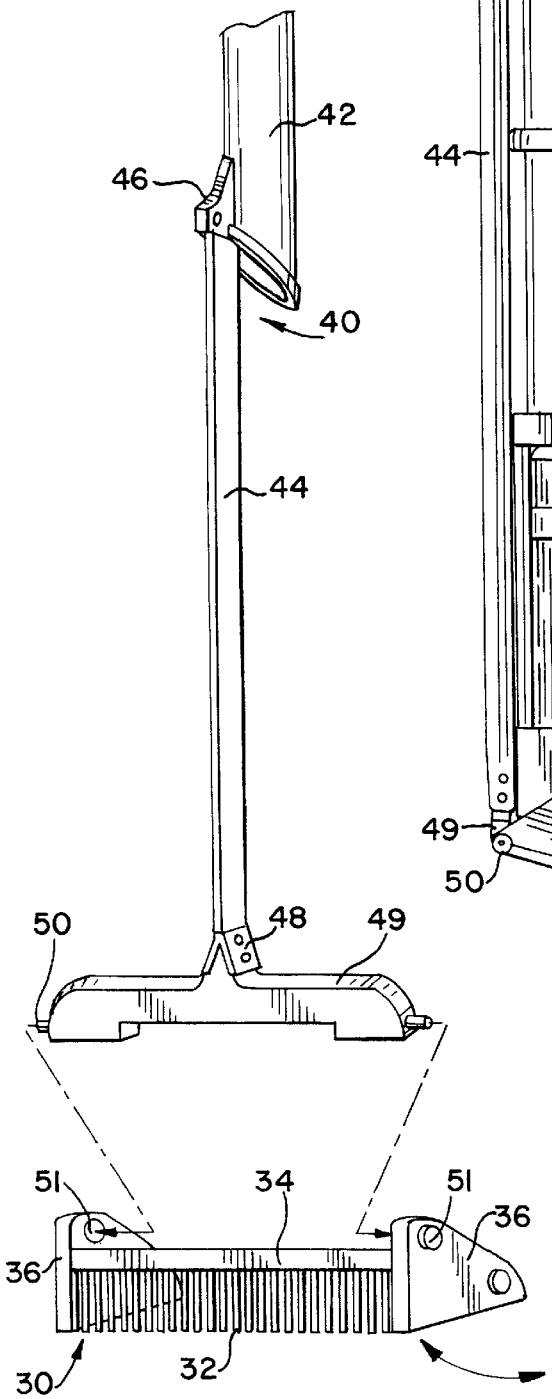
FIG. 6 is an exploded perspective view of the comb assembly and actuator mechanism.

As best seen in FIGS. 1 and 6, the comb assembly 30 is operated by an actuator mechanism 40. The actuator mechanism 40 is comprised of a handle or slidable sleeve which may be formed for convenience as a grasping portion. It may include a foam cover or the like for easy gripping. The handle 42 surrounds the lower portion of the handle 12 and is allowed to freely slide laterally along the handle 12 between pre-determined fixed points. A rigid connecting member 44 has its top end connected to the bottom of the handle 42 by means of a pin connection 46. A bottom end of 48 of the rigid connecting member 44 is connected to a cross bar 49 which, in turn, is connected to the comb assembly 30 by means of two opposed comb pivot pins 50. The pivot pins 50 are received in holes 51 in one corner of the link 36. This allows the cross bar 49 which is connected to the rigid connecting member 44 to pivot with respect to the comb head 34.

Also surrounding a lower portion of the elongated handle 12 above the bottom end 16 is a top collar 52. The top collar 52 is also moveable along the longitudinal axis of the handle 12. The top collar 52 is connected to the bottom collar 28 by means of a collar connector 54. The connector is preferably made of a strong rigid material such that the top collar 52 and bottom collar 28 remain a fixed distance apart, yet firmly connected.

Figure 9:
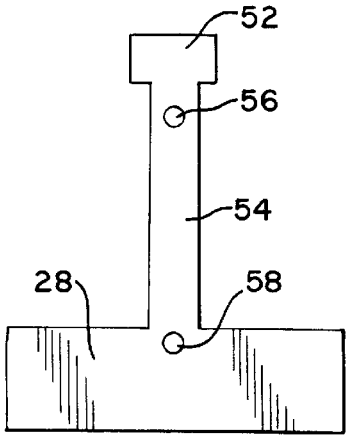
FIG. 9 is a rear view of the top and bottom collars with portions removed.

As seen in FIG. 9, there is a recess indentation or hole 56 on the collar connector 54. There is another similar recess 58 on the bottom collar 28. Located on the cleaning head 18 is a protrusion or ball 60 which extends outward from the cleaning head 18. The protrusion 60 engages either of the recesses 56, 58, depending upon the position of the collars 52, 58.

Figure 3:
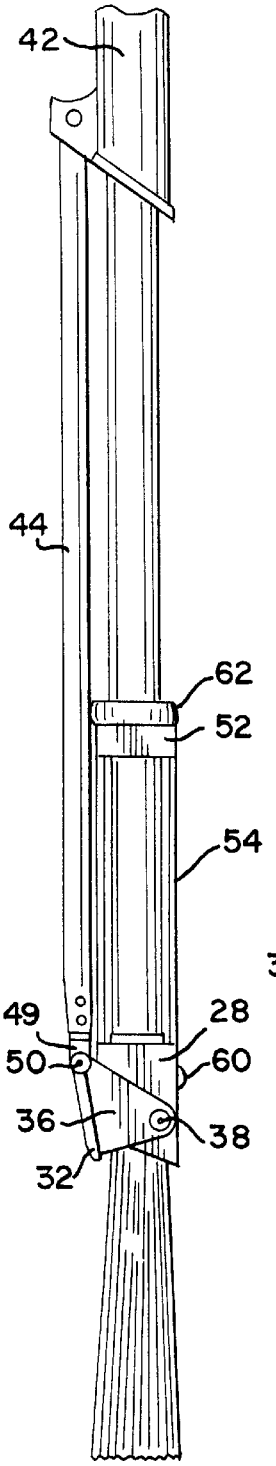
FIG. 3 is a right side elevation view with portions removed of the broom of FIG. 2.
Figure 4:
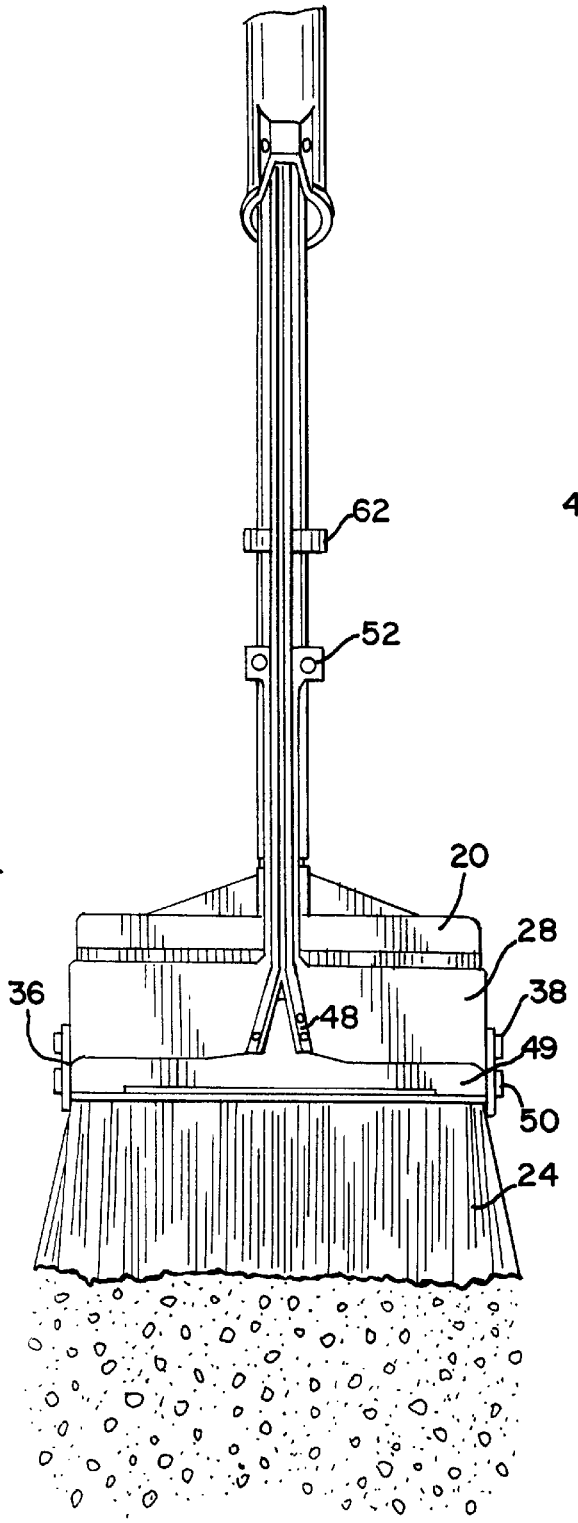
FIG. 4 is a front elevation view with portions removed of the broom with the comb pivoted and engaging the bristles and with the grasping portion beginning its downward travel toward the cleaning head.
Figure 5:
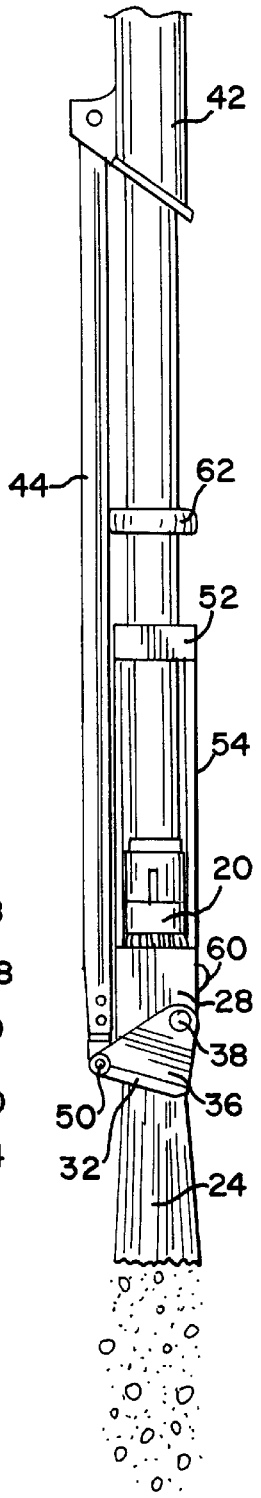
FIG. 5 is a right side elevation view with portions removed of the broom assembly shown in FIG. 4.
Figure 7:
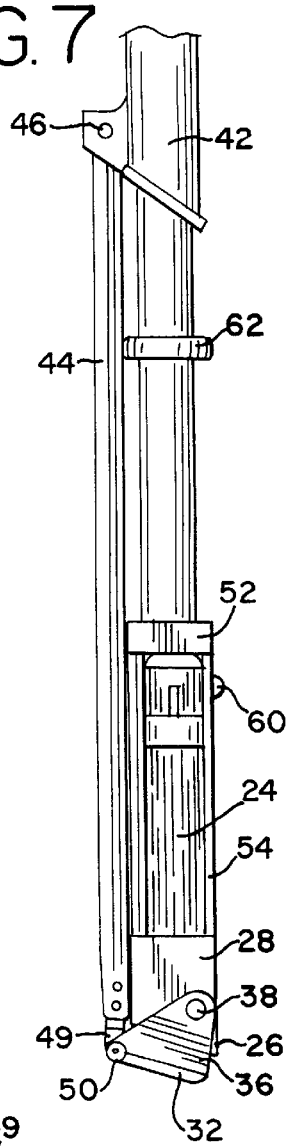
FIG. 7 is a right side elevation view with portions removed with the grasping portion at the bottom most position of its travel and the comb extending beyond the bottom of the bristles.

For example, with the sleeve 42 in its uppermost position as seen in FIG. 3, the protrusion 60 is retained in the recess 58. Thus, the bottom collar 28 remains semi-locked into its uppermost position. The handle 42 is in its first position at its highest point of travel. The top collar 52 engages a stop 62, on the handle 42, which restrains any further upward motion of the top collar 52. When a downward force is applied to the handle 42, it is transferred through the connecting member 44, to the cross bar 49, then to the comb pivot pins 50. This causes the comb head 34 and tines 32 to pivot around the collar pivot pin 38 until the link 36 assumes the position illustrated in FIG. 5. The tines 32 have now engaged the bristles 24. A continued downward force on the handle 42 causes the recess 58 to be released from the protrusion 60. This results in the movement of the handle 42 downward toward the cleaning head 18. The rigid connecting member 44 pushes the comb assembly 30 and bottom collar 28 connected thereto downward toward the opposite end of the bristles 26. At the same time, the tines 32 are combed through the bristles 24 and successively assume the positions shown in FIGS. 5 and 7. As can be seen in FIG. 7, the bottom collar 28 still encompasses the opposite end of the bristles 26 but the tines 32 have passed through the bristle ends 26. Thus, any dirt or particles entrapped in the bristles 24 are combed and pushed out from the bristles.

Figure 8:
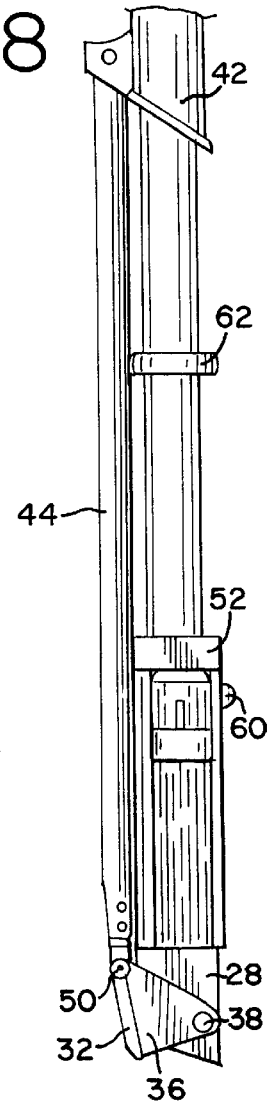
FIG. 8 is a right side elevation view with portions removed with the grasping portion beginning its upward travel and the comb pivoted such that the tines no longer engage the bristles.

In the position shown in FIGS. 7 and 8, the recess 56 mates with and is retained by the protrusion 60. As the handle 42 is pulled back toward the top end 14 of the handle 12, the rigid connecting member 44 pulls upwardly on the comb assembly 30 causing it to pivot via link 36 around the collar pivot pin 38. This occurs because the force to pivot the comb assembly 30 about the collar pivot pin 38 is greater than the force that the protrusion 60 applies to the recess 56. However, once the comb head 34 assumes the position shown in FIG. 8, the force of the protrusion 60 on the recess 56 is overcome by the force applied by the user to the handle 42, and the bottom collar 28 begins moving upward until the top collar 52 strikes the stop 62 and assumes the original position show in FIG. 3.

In the preferred embodiment, a protrusion 60 was used to engage the recesses 56 and 58. The protrusion can be either a molded part of the cleaning head 18 or a spring loaded ball. Another means of applying the restraining forces to the collar would be a frictional engagement between the top or bottom collar and a portion on the cleaning head 18. Any form of frictional engagement properly applied to the bottom or top collar at the appropriate positioning with respect to the actuator mechanism 40 will work such that the comb head 30 will pivot to engage the bristles on the downward movement of the handle 42 and pivot out from engaging the bristles on the upward movement of the handle 42. As can be readily appreciated, the tines 32 must be retracted from engagement with the bristles 24 as the handle 42 is drawn back upwardly toward its initial position shown in FIG. 3.

Thus, there has been provided a broom for cleaning a surface having a bristle cleaning mechanism that fully satisfies the objects, aims and advantages as set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A broom for cleaning a surface comprising:

a handle having a longitudinal axis and top and bottom ends, a cleaning head at the bottom end of the handle, a plurality of bristles having opposite ends, with one end of the bristles affixed to the cleaning head and the opposite end of the bristles adapted for cleaning the surface, a lower collar surrounding the one end of the bristles a comb member having a plurality of tines, the comb member pivotally connected to the lower collar to allow the comb member to be pivoted from a first position, with the tines not engaging the bristles, to a second position, with the tines in contact with the bristles, and means to push the tines through the bristles from the one end of the bristles toward the opposite end of the bristles, once the comb member is pivoted to the second position.

2. The broom of claim 1 wherein the tines are pushed past the opposite ends of the bristles to remove dust collected between the tines.

3. The broom of claim 2 wherein the lower collar moves with the comb member from the one end of the bristles toward the opposite ends of the bristles, the lower collar surrounding the bristles as it moves from the one end to the opposite end, and continues to surround the bristles as the tines extend past the opposite ends of the bristles.

4. The broom of claim 3 wherein the comb member pivots to the first position before the comb member and lower collar are retracted to their original position adjacent to the one end of the bristles by means of the actuator.

5. The broom of claim 1 and further comprising an actuator manually movable along the longitudinal axis of the handle and having at one end of the actuator the comb member and at the other end a grasping portion, the movement of the actuator along the longitudinal axis of the handle causing the comb member to pivot between the first position and the second position.

6. The broom of claim 5 and further comprising means for operably connecting the grasping portion to the comb member.

7. The broom of claim 1 wherein the comb member pivots between the first and second positions by exerting a force on the comb member to cause the comb member to pivot between the first and second positions, the cleaning head having means for holding the comb members in the first or second position until the force on the comb member overcomes the holding force of the means for holding the comb member, thus causing the comb member to pivot.

8. The broom of claim 7 wherein the means for holding the comb member in the first or second positions comprise at least two detents formed on the actuator mechanism, the detents being associated with the first and second positions, and at least one protrusion that mates with a detent in the first position and that mates with another detent in the second position.

9. The broom of claim 8 wherein the protrusion is integrally formed with the cleaning head.

10. The broom of claim 9 wherein the protrusion is a ball urged toward the detent by a spring mounted in a cavity in the cleaning head.

11. The broom of claim 7 wherein the means for holding the comb member in the first or second positions comprise mating surfaces between the actuator mechanism and the broom head until the force on the actuator mechanism overcomes the holding force of the mating surfaces.

12. A broom for cleaning a surface comprising:

an elongated handle having a longitudinal axis and opposite top and bottom ends, a cleaning head disposed at the bottom end of the handle, a plurality of bristles having opposite ends with one end of the bristles affixed to the cleaning head and the opposite end of the bristles adapted for cleaning the surface, a comb member having a plurality of tines, the comb member mounted for pivotal movement between at least two positions, a first position with the tines not engaging the bristles and a second position with the tines engaging the bristles, a slidable sleeve mounted on the elongated handle for limited lateral movement along the handle, means on the sleeve operatively connected to the comb member for actuating pivoting of the comb member from either of its two positions, whereby when the slidable sleeve is slid from an initial position above the cleaning head toward the cleaning head, the comb member is pivoted to the second position and the tines are pushed through the bristles from the one end past the opposite end to remove dust from the bristles.

13. The broom of claim 12 wherein the means on the sleeve connected to the comb member pivots the comb member to the first position when the sleeve is slid back to its initial position.

14. The broom of claim 12 and further comprising a lower collar surrounding the one end of the bristles affixed to the cleaning head, the comb member pivotally connected to the lower collar.

15. The broom of claim 14 wherein the lower collar moves with the comb member from the one end of the bristles toward the opposite ends of the bristles, the lower collar surrounding the bristles as it moves from the one end to the opposite end, and continues to surround the bristles as the tines extend past the opposite ends of the bristles.

16. The broom of claim 14 wherein the means on the sleeve operatively connected to the comb member comprise a connecting rod with one end connected to the sleeve and an opposite end connected to the comb member.

17. The broom of claim 12 wherein the comb member pivots between the first and the second positions by exerting a force on the comb member to cause the comb members to pivot between the first and second positions, and means for holding the comb member in the first or second position until the force on the comb member overcomes the holding force of the means for holding the comb member, thus causing the comb member to pivot.

18. The broom of claim 17 wherein the means for holding the comb member in the first or second positions comprise at least two detents formed on the slidable sleeve, the detents being associated with the first and second positions, and at least one protrusion that mates with a detent in the first position and that mates with another detent in the second position.

19. The broom of claim 18 wherein the protrusion is integrally formed with the cleaning head.

20. The broom of claim 17 wherein the means for holding the comb member in the first or second positions comprise mating surfaces between the slidable sleeve and the broom head until the force on the slidable sleeve overcomes the holding force of the mating surfaces.

* * * * *